US010016115B2

(12) United States Patent
Gerstner et al.

(10) Patent No.: US 10,016,115 B2
(45) Date of Patent: Jul. 10, 2018

(54) LIFTING DEVICE AND DISHWASHER

(71) Applicant: BSH Hausgeräte GmbH, Munich (DE)

(72) Inventors: Norbert Gerstner, Herbrechtingen (DE); Ersin Isbilen, Lauingen (DE); Thomas Steck, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 15/137,045

(22) Filed: Apr. 25, 2016

(65) Prior Publication Data

US 2016/0309982 A1 Oct. 27, 2016

(30) Foreign Application Priority Data

Apr. 24, 2015 (DE) ..... 10 2015 207 564
Jun. 19, 2015 (DE) ..... 10 2015 211 362

(51) Int. Cl.
*A47L 15/50* (2006.01)

(52) U.S. Cl.
CPC ..... *A47L 15/506* (2013.01)

(58) Field of Classification Search
CPC .... A47L 15/506; A47L 15/504; A47L 15/507; A47L 15/502; A47L 15/50; A47L 15/4246; A47B 2088/901; A47B 46/005; A47B 2210/17
USPC ..... 312/310, 228.1, 351, 319.3, 228, 41.4; 211/41.8, 41.9, 41.4
See application file for complete search history.

(56) References Cited

U.S. PATENT DOCUMENTS 3,768,883 A * 10/1973 Kauffman ..... A47L 15/504 108/147
5,115,822 A 5/1992 Nichols
5,971,513 A * 10/1999 Cassalia ..... A47L 15/506 312/272
6,247,771 B1 6/2001 Miller
6,755,490 B2 * 6/2004 Welch ..... A47L 15/504 312/228.1
7,625,052 B2 * 12/2009 Kim ..... F25D 23/021 312/402
7,628,461 B2 * 12/2009 Carden ..... F25D 25/025 312/310
8,162,419 B2 4/2012 Dellby et al.
8,303,053 B2 * 11/2012 Bond ..... A47B 46/005 312/319.2

(Continued)

FOREIGN PATENT DOCUMENTS

EP 0147815 A2 7/1985
EP 1066789 A1 1/2001

(Continued)

*Primary Examiner* — Hiwot E Tefera
(74) *Attorney, Agent, or Firm* — Michael E. Tschupp; Andre Pallapies; Brandon G. Braun

(57) ABSTRACT

A lifting device for displacing a receiver for items to be washed in a dishwasher from an initial position into an end position, or vice versa, includes a blocking device configured to automatically block the receiver for items to be washed in at least one intermediate position between the initial position and the end position. The blocking device includes an actuating element which, when actuated, is configured to unlock the blocking device such that the receiver for items to be washed can be displaced from the initial position to the end position, or vice versa, only for so long as the actuating element remains actuated to unlock the blocking device.

22 Claims, 10 Drawing Sheets

(56) References Cited

U.S. PATENT DOCUMENTS

| | | | | |
|---|---|---|---|---|
| 8,550,592 | B2 | 10/2013 | Usuda et al. | |
| 9,004,622 | B2 * | 4/2015 | Garcia | A47B 46/005 312/228.1 |
| 2003/0042825 | A1 * | 3/2003 | Welch | A47L 15/504 312/228.1 |
| 2004/0244825 | A1 * | 12/2004 | Ashton | A47L 15/506 134/85 |
| 2006/0043848 | A1 * | 3/2006 | Jeong | A47B 46/00 312/310 |
| 2012/0074080 | A1 * | 3/2012 | Garcia | A47B 46/005 211/41.9 |
| 2015/0002005 | A1 | 1/2015 | Park et al. | |
| 2015/0305493 | A1 | 10/2015 | Garcia et al. | |
| 2017/0027413 | A1 * | 2/2017 | Gerstner | A47L 15/506 |

FOREIGN PATENT DOCUMENTS

| | | | |
|---|---|---|---|
| JP | 2000000201 | A | 1/2000 |
| JP | 2001224547 | A | 8/2001 |
| JP | 2006141515 | A | 6/2006 |
| JP | 2006141516 | A | 6/2006 |
| JP | 2006141526 | A | 6/2006 |
| WO | 2014102367 | A1 | 7/2014 |
| WO | 2014102374 | A1 | 7/2014 |

* cited by examiner

LIFTING DEVICE AND DISHWASHER

CROSS-REFERENCES TO RELATED APPLICATIONS

This application claims the priority of German Patent Applications, Serial No. DE 10 2015 207 564.8, filed Apr. 24, 2015, and Serial No. DE 10 2015 211 362.0, filed Jun. 19, 2015, pursuant to 35 U.S.C. 119(a)-(d), the disclosures of which are incorporated herein by reference in their entirety as if fully set forth herein.

BACKGROUND OF THE INVENTION

The present invention relates to a lifting device for a receiver for items to be washed in a dishwasher and a dishwasher with such a lifting device.

The following discussion of related art is provided to assist the reader in understanding the advantages of the invention, and is not to be construed as an admission that this related art is prior art to this invention.

Conventional dishwashers normally include a washing container and at least one receiver for items to be washed which is able to be displaced into or out of the washing container. The dishwasher may include a plurality of receivers for items to be washed arranged above one another, such as a lower basket, an upper basket or a cutlery basket, for example. Since a lower basket may be arranged in a vicinity of a base of the washing container, the user is obliged to kneel down or bend forward over the lower basket while loading and unloading the lower basket.

It would be desirable and advantageous to provide an improved lifting device for a receiver for items to be washed of a dishwasher that is user-friendly and safe while yet being reliable in operation.

SUMMARY OF THE INVENTION

According to one aspect of the present invention, a lifting device for displacing a receiver for items to be washed in a dishwasher from an initial position into an end position, or vice versa, includes a blocking device configured to automatically block the receiver for items to be washed in at least one intermediate position between the initial position and the end position and including an actuating element which, when actuated, is configured to unlock the blocking device such that the receiver for items to be washed can be displaced from the initial position to the end position, or vice versa, only for so long as the actuating element remains actuated to unlock the blocking device.

According to another aspect of the present invention, a dishwasher includes a receiver for items to be washed including a lifting device as set forth above. The dishwasher may be a domestic dishwasher.

Since the blocking device blocks the receiver for items to be washed when the actuating element is not actuated, an automatic displacement of the receiver for items to be washed is prevented due to its dead weight and/or the weight of the items to be washed contained therein. An uncontrolled movement of the receiver for items to be washed is therefore not possible. The receiver for items to be washed is thus only able to be displaced by manual guidance. As a result, the risk of injury to a user is reduced. Preferably, the receiver for items to be washed may be blocked in every possible position or any intermediate position between the initial position and the end position. It is thus possible to block the receiver for items to be washed automatically in at least one intermediate position, i.e. even in two or more intermediate positions between the initial position and the end position.

The receiver for items to be washed is preferably a lower basket of the dishwasher. The dishwasher may also include an upper basket and/or a cutlery basket.

According to one advantageous feature of the present invention, the actuating element can be mechanically coupled to the blocking device. In another advantageous feature, however, the actuating element can be coupled fluidly or in a different manner to the blocking device.

The actuating element is operatively connected to the blocking device by means of a linkage system or a Bowden cable, for example. Advantageously, the blocking device can be designed to automatically block the receiver for items to be washed if the mechanical coupling between the actuating element and the blocking device is interrupted.

According to another advantageous feature of the present invention, the actuating element is coupled to the blocking device by means of signal technology. For example, the blocking device may include an actuator which is able to be actuated electrically and which is operatively connected to the actuating element by means of a cable. The actuating element may be a pushbutton or a switch.

According to another advantageous feature of the present invention, the actuating element can be arranged on the receiver for items to be washed. Preferably, the actuating element is provided on the front face of the receiver for items to be washed. As a result, the actuating element is able to be accessed in a particularly simple manner.

According to another advantageous feature of the present invention, the lifting device can include a drive device for displacing the receiver for items to be washed. As a result, a user is assisted when displacing the receiver for items to be washed. Preferably, the drive device is able to be switched on and off by means of the actuating element.

According to another advantageous feature of the present invention, the drive device can include an active drive element and/or a passive drive element. The active drive element may be an electric motor, for example. The passive drive element may be a gas pressure spring, for example. The electric motor may be arranged in a space-saving manner on a top surface of the washing container of the dishwasher.

According to another advantageous feature of the present invention, the drive device can include a gear mechanism. As a result, the electric motor may have smaller dimensions. Moreover, the rotational movement of the electric motor can be converted into a pivoting movement of the receiver for items to be washed. The gear mechanism may include a worm, a gear wheel and/or a toothed rod.

According to another advantageous feature of the present invention, the gear mechanism can be a self-locking worm gear. Preferably, the worm gear includes a worm and the gear wheel. The blocking device may include the worm and/or the gear wheel.

According to another advantageous feature of the present invention, the blocking device can include a magnetic element which is designed to block the gear mechanism magnetically. The magnetic element may be, for example, a permanent magnet which is applied to the gear wheel for blocking the lifting device. Alternatively, the magnetic element may be an electromagnet which, for example, is spaced apart at a uniform distance from the gear wheel and is activated for braking and blocking the gear wheel.

According to another advantageous feature of the present invention, the blocking device can include an engagement element which is designed to engage positively in the gear mechanism in order to block the gear mechanism mechanically. The engagement element may preferably be tooth-shaped or plunger-shaped. The engagement element is designed to engage positively in the gear wheel or the toothed rod of the gear mechanism.

According to another advantageous feature of the present invention, the engagement element can be spring-pretensioned in a direction of a gear wheel and/or a toothed rod of the gear mechanism. As a result, the blocking element is designed to block the lifting device even when the coupling between the actuating element and the engagement element is interrupted.

According to another advantageous feature of the present invention, the engagement element is able to be displaced magnetically. The engagement element may be operatively connected to a magnetic actuator. The magnetic actuator may include a solenoid.

According to another advantageous feature of the present invention, the blocking device includes a braking element which is designed to block the gear mechanism by a frictional connection. The braking element is preferably designed to block the gear wheel or the toothed rod.

According to another advantageous feature of the present invention, the braking element is a friction wheel or a brake shoe. A brake shoe may preferably be provided in each case on both sides of the gear wheel. As a result, a particularly reliable blocking is achieved.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
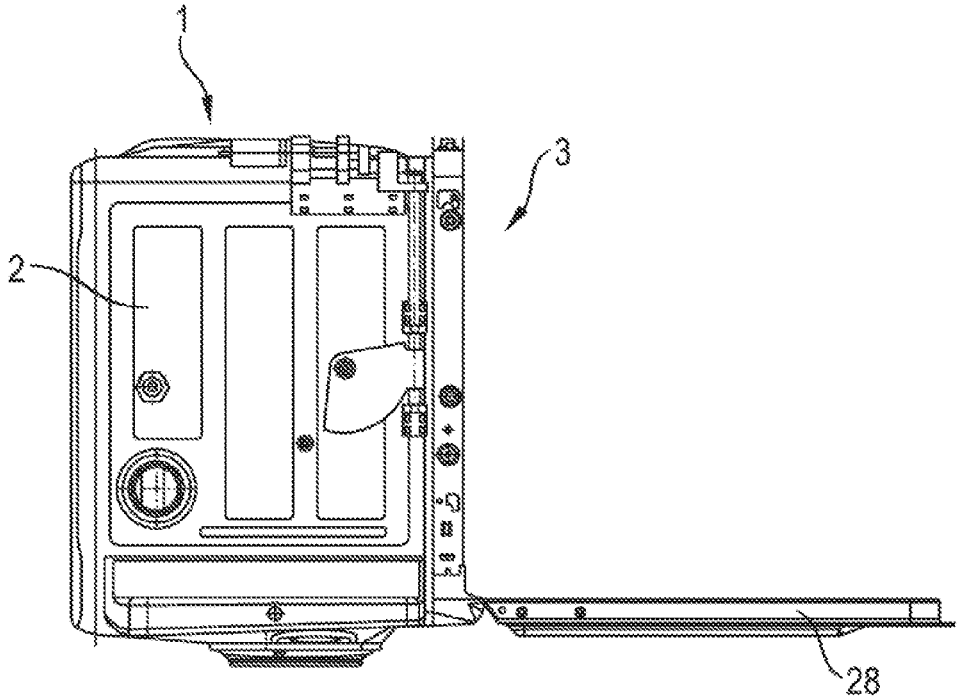
FIG. 1 shows a schematic side view of a dishwasher according to the present invention.

Throughout all the figures, same or corresponding elements are generally be indicated by same reference numerals.

Turning now to the drawing, and in particular to FIG. 1, there is shown a schematic side view of an embodiment of a dishwasher according to the present invention, generally indicated by reference numeral 1. FIGS. 2-6 show the dishwasher 1 in each illustration in a further side view. Hereinafter reference is simultaneously made to FIGS. 1-6.

The dishwasher 1 is preferably a domestic dishwasher. The dishwasher 1 has a washing container 2. The washing container 2 is preferably cuboidal, and manufactured from sheet steel. Alternatively, the washing container 2 may be manufactured at least partially from a plastics material. The washing container 2 has on the front face an opening 3 which is able to be closed in a water-tight manner by means of a door 28. The dishwasher 1 includes at least one receiver for items to be washed 4, shown in FIGS. 2-5. The dishwasher 1 may include a plurality of receivers for items to be washed 4. The receiver for items to be washed 4 is in the shape of a wire frame or basket. The receiver for items to be washed 4 may be a lower crockery basket or lower basket of the dishwasher 1. Moreover, the dishwasher 1 may include an upper basket and/or a cutlery basket, though not shown.

Figure 2:
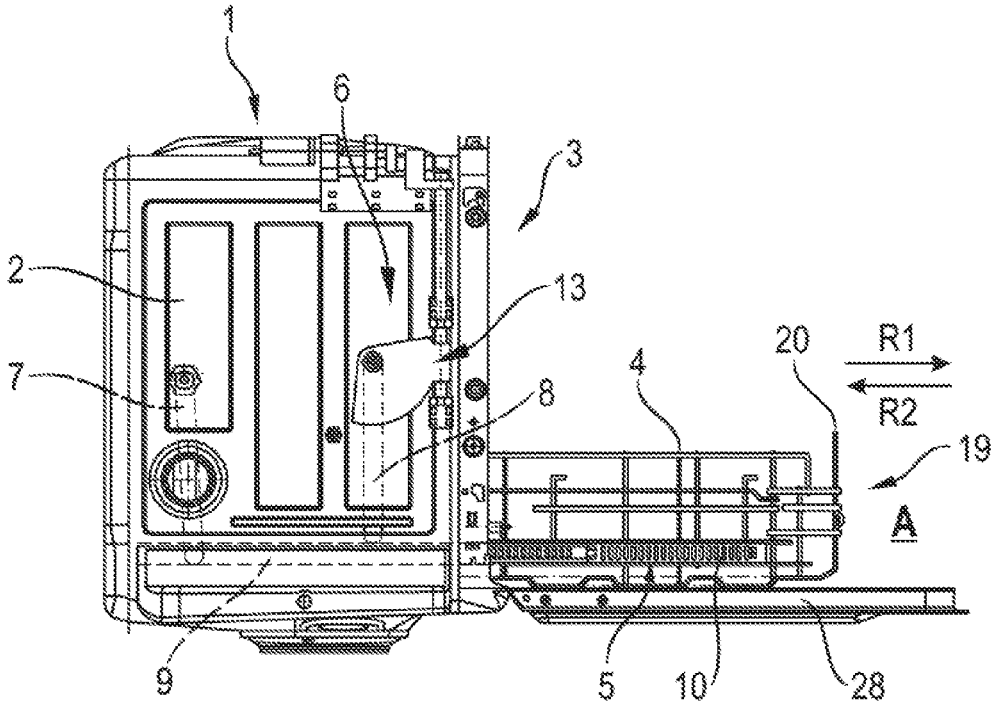
FIG. 2 shows a schematic side view of the dishwasher according to FIG. 1, illustrating an initial position of the receiver for items to be washed.

The receiver for items to be washed 4, as shown in FIG. 2, is optionally able to be inserted into the washing container 2 or removed therefrom. The receiver for items to be washed 4 is able to be pulled out of the washing container 2 in a pull-out direction R1 and pushed into the washing container 2 in a push-in direction R2. The receiver for items to be washed 4 is able to be pushed in or pulled out of the washing container 2 by means of a telescopic rail 5, as shown in FIGS. 2-5. Preferably, such telescopic rails 5 are provided on both sides of the receiver for items to be washed 4. The telescopic rails 5 may be suspended in side walls of the washing container 2, either screwed thereto or otherwise fixedly connected thereto. The receiver for items to be washed 4 is suspended in the telescopic rails 5 and is able to be detached therefrom. By means of the telescopic rails 5 the receiver for items to be washed 4 may be fully extended out from the washing container 2.

Figure 4:
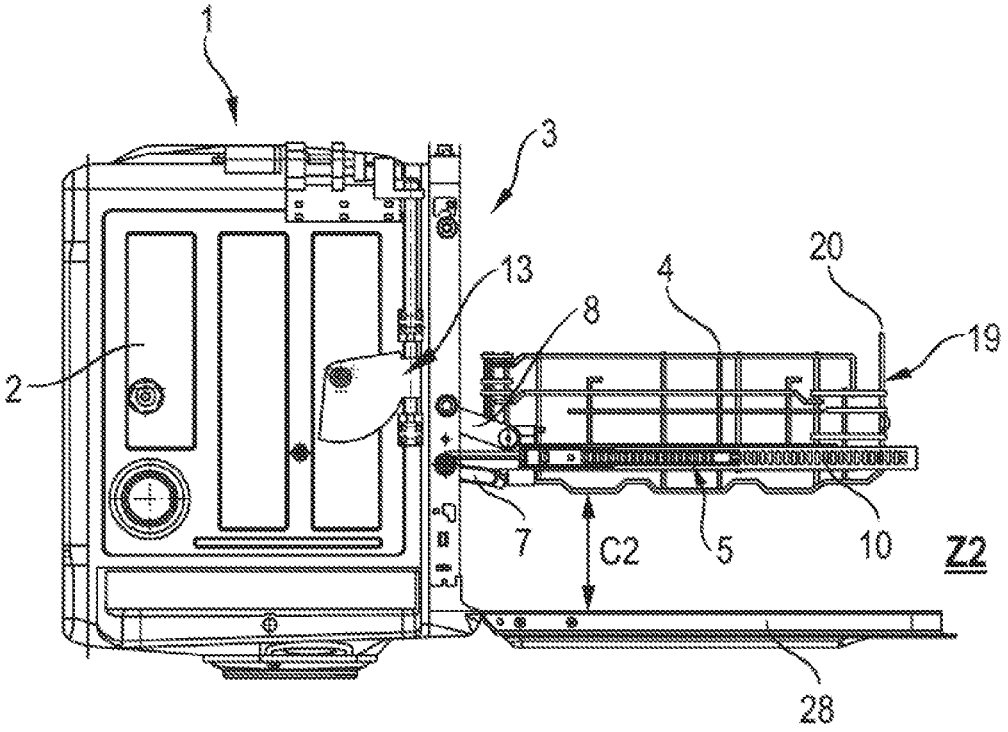
FIG. 4 shows a further schematic side view of the dishwasher according to FIG. 1, illustrating a second intermediate position of the receiver for items to be washed.
Figure 5:
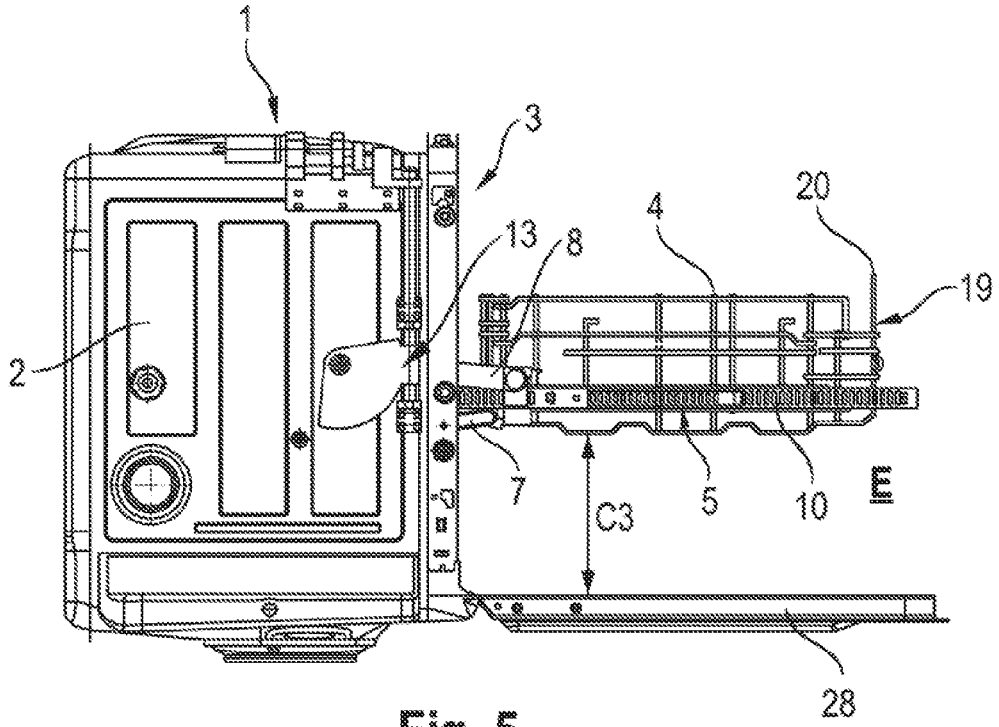
FIG. 5 shows a further schematic side view of the dishwasher according to FIG. 1, illustrating an end position of the receiver for items to be washed.

The dishwasher 1 further includes a lifting device 6 which is designed to lift the receiver for items to be washed 4 from an initial position A shown in FIG. 2 into an end position E shown in FIG. 5, or to lower the receiver for items to be washed 4 from the end position E into the initial position A. The lifting device 6 includes two first pivoting arms 7, in each case attached at the side to the telescopic rails 5, and two second pivoting arms 8 provided in each case at the side on the telescopic rails 5, as shown in FIGS. 2-5. The pivoting arms 7, 8 are arranged spaced apart from one another and in each case fastened in a pivotable manner to the washing container 2 on the inner face. The pivoting arms 7, 8 are pivotably fastened to a first guide rail 9, as shown in FIG. 2, of the telescopic rail 5 on a second end portion of the pivoting arms 7, 8 opposing the first end portion fastened to the washing container 2. In addition to the first guide rail 9, the telescopic rail 5 includes a second guide rail 10, as shown in FIGS. 2-5. A central guide rail (not shown) is arranged between the first guide rail 9 and the second guide rail 10. By pivoting the pivoting arms 7, 8, the receiver for items to be washed 4 may be lifted from an initial position A shown in FIG. 1 into an end position E shown in FIG. 5. In the end position E shown in FIG. 5, the receiver for items to be washed 4 has a vertical spacing C3 ranging from 22 to 30 cm, preferably from 23 to 28 cm, and more precisely approximately 25 cm, from the door 28 of the dishwasher.

Figure 6:
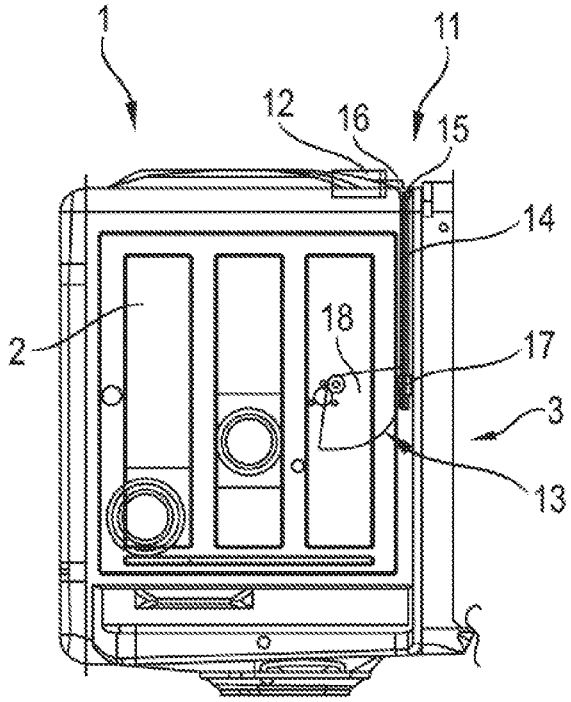
FIG. 6 shows a further schematic side view of the dishwasher according to FIG. 1.

The lifting device 6 further includes a drive device 11, shown in FIG. 6, which includes an electric motor 12 or a gas pressure spring. The electric motor 12 may be provided on a top surface of the washing container 2. The drive device 11 further includes a gear mechanism 13. The gear mechanism 13 has a vertically extending drive shaft 14 which is connected to the electric motor 12 via bevel gears 15, 16. A worm 17 is provided on or adjacent to the drive shaft 14. A worm gear or gear wheel 18 engages in the worm 17. The gear wheel 18 may be circular segment-shaped or circular. The gear wheel 18 is connected fixedly in terms of rotation to the pivoting arm 8. The dishwasher 1 may include one drive device 11 or two drive devices 11.

The lifting device 6 includes a blocking device 19, which is designed to block the receiver for items to be washed 4 automatically in at least any intermediate position between the initial position A and the end position E. The blocking device 19 includes an actuating element 20 for locking and unlocking the blocking device 19, as shown in FIGS. 2-5. The actuating element 20 may be provided on the receiver for items to be washed 4. The actuating element 20 preferably may be a lever, pushbutton, or switch provided on the front face of the receiver for items to be washed 4.

Figure 3:
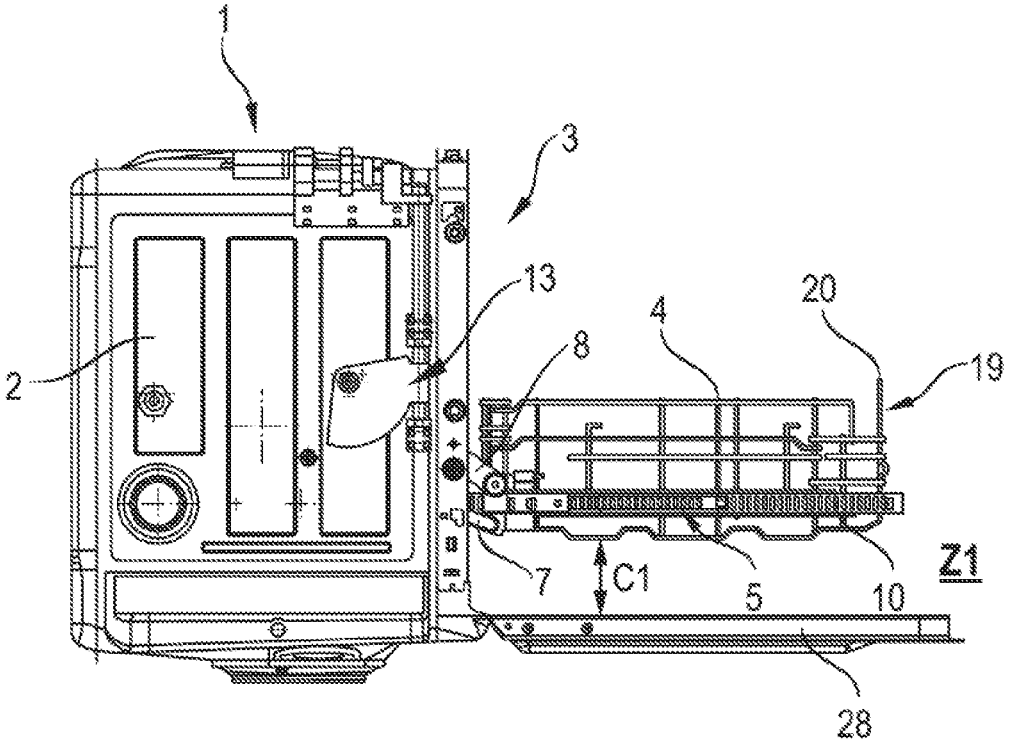
FIG. 3 shows a further schematic side view of the dishwasher according to FIG. 1, illustrating a first intermediate position of the receiver for items to be washed.

FIG. 3 shows the receiver for items to be washed 4 in a first intermediate position Z1 in which it has a vertical spacing C1 ranging from 8 to 16 cm, preferably from 10 to 14 cm, and more precisely approximately 12 cm, from the door 28 of the dishwasher 1. This vertical spacing C1 is due to a safety feature which has to be at least fulfilled. If the receiver for items to be washed 4 falls out of an upper position, the blocking device 19 has to retain it at a minimum spacing, which is preferably identical to the vertical spacing C1, in order to prevent the head of a child from being jammed and/or squashed, for example. This spacing C1 may also be defined as the "safety zone".

FIG. 4 shows the receiver for items to be washed 4 in a second intermediate position Z2 in which it has a vertical spacing C2 ranging from 16 to 22 cm, preferably from 18 to 21 cm, and more precisely approximately 20 cm, from the door 28 of the dishwasher 1. After the lowering movement has been released again, the acceleration of the receiver for items to be washed 4 would be less than without the blocking action, so that the dynamic jamming force is considerably less. Deliberate handling by the operator is provided from this blocked position. The receiver for items to be washed is blocked in a second intermediate position Z2 at a defined spacing C2 relative to the initial position A. Since in certain mechanical lifting devices the assisting action for the lifting procedure is reduced as the lifting height increases (as the lifting angle increases)—this means that the actuating force and/or the lifting force on the part of the operator is increased. Thus it is necessary, from a safety point of view, to introduce a second intermediate position Z2 to be blocked. This second intermediate position Z2 ensures that if the force applied by the operator is reduced the operator still has the option to block the receiver for items to be washed 4 before the end position E is reached.

The receiver for items to be washed 4 is only able to be displaced from the initial position A into the end position E or vice versa if the actuating element 20 is actuated in order to unlock the blocking element 19. The receiver for items to be washed 4 is thus manually guided. This means that as soon as a user no longer actuates the actuating element 20, the receiver for items to be washed 4 remains in its current position. The actuating element 20 may be coupled to the blocking device 19 mechanically, fluidly, or by signal technology.

Figure 7:
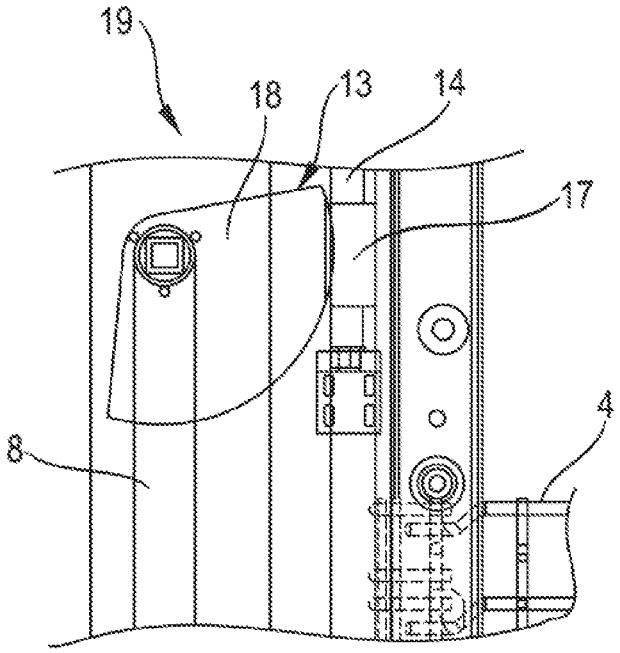
FIG. 7 shows a schematic side view of an embodiment of a blocking device for the dishwasher according to FIG. 1.
Figure 8:
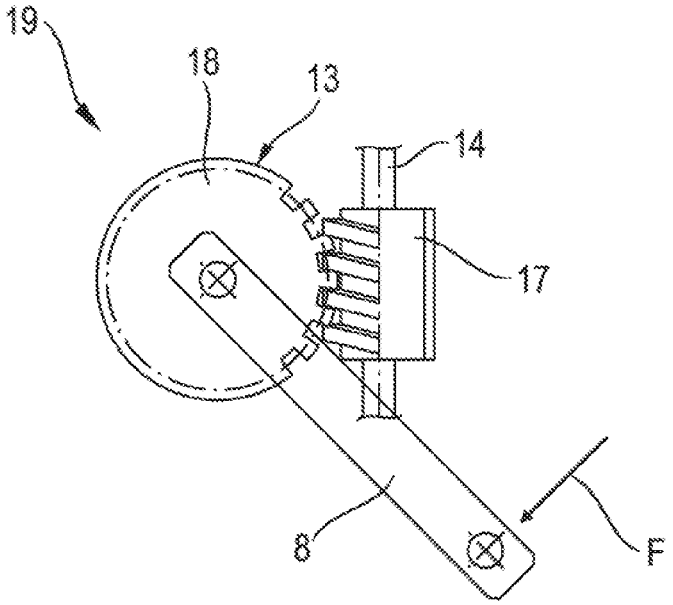
FIG. 8 shows a further schematic side view of the blocking device according to FIG. 7.

For example, the blocking device 19 in an embodiment for the dishwasher 1 may include the worm 17 and the gear wheel 18, as shown in FIGS. 7 and 8. The gear mechanism 13 is a self-locking worm gear. To unlock the blocking device 19, the electric motor 12 is switched on by means of the actuating element 20, whereby the receiver for items to be washed 4 is lifted from the initial position A into the end position E or lowered, in reverse. As soon as the actuating element 20 is no longer actuated, the electric motor 12 is switched off and the blocking device 19 in the form of the worm 17 and the gear wheel 18 blocks the receiver for items to be washed 4 due to its self-locking properties in at least any intermediate position between the initial position A and the end position E. As FIG. 8 shows, when a force F is applied onto the second pivoting arm 8, the receiver for items to be washed 4 is not displaced, as the worm 17 and the gear wheel 18 are configured to be self-locking.

Figure 9:
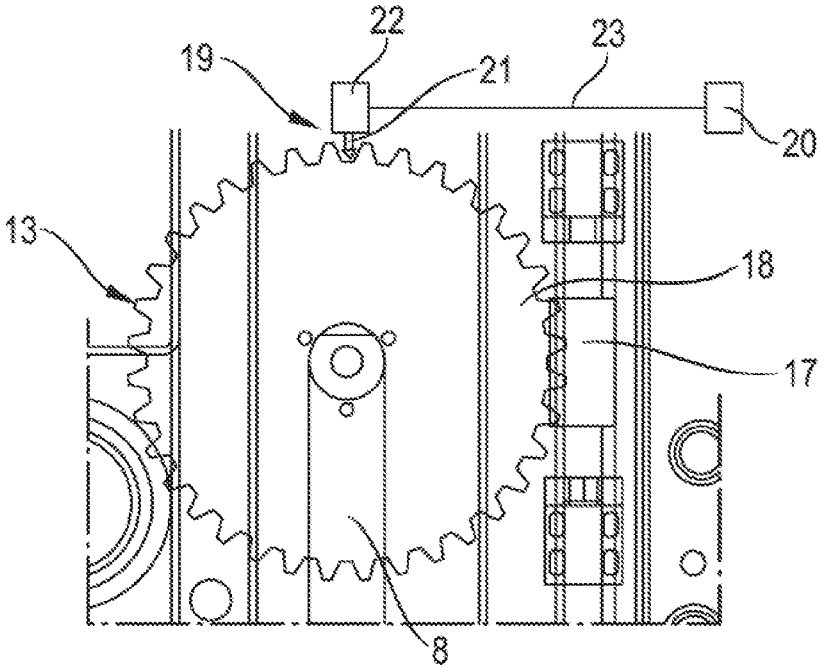
FIG. 9 shows a schematic side view of another embodiment of a blocking device for the dishwasher according to FIG. 1.
Figure 10:
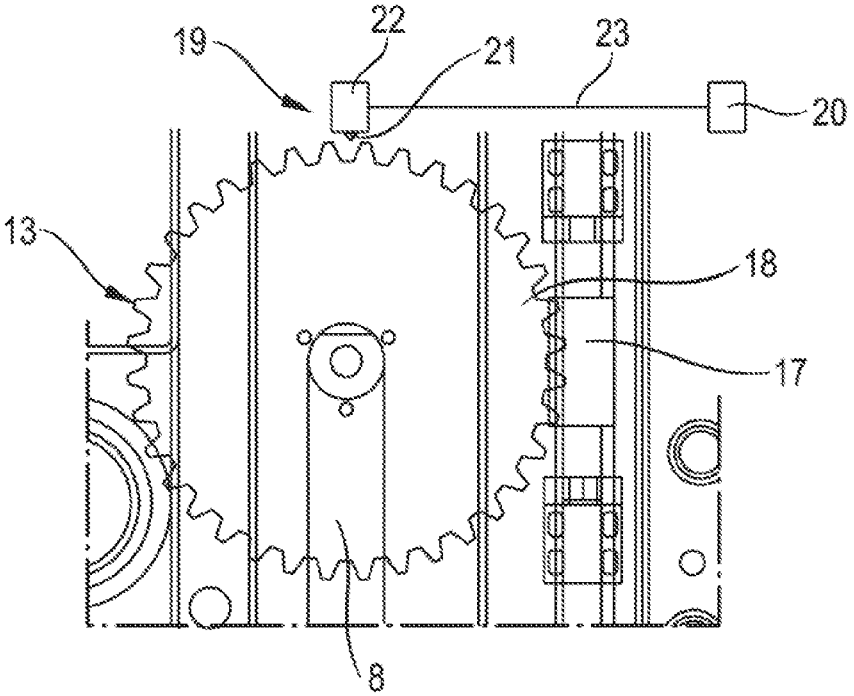
FIG. 10 shows a further schematic side view of the blocking device according to FIG. 9.

FIGS. 9 and 10 show another embodiment of a blocking device 19 for the dishwasher 1 according to FIG. 1. The blocking device 19 includes, in addition to an actuating element 20, an engagement element 21 which is designed to engage positively in the gear mechanism 13 and, in particular, in the gear wheel 18 in order to block this gear mechanism mechanically. The engagement element 21 may be spring-pretensioned in a direction of the gear wheel 18. The engagement element 21 is coupled to an actuator 22, in particular a magnetic actuator 22. The actuator 22 may be a magnetic valve. The actuator 22 is operatively connected to the actuating element 20 via a signal line 23. When actuating the actuating element 20, the actuator 22 is activated so that the engagement element 21 is pulled back from the gear wheel 18, as shown in FIG. 10. When the actuating element 20 is not activated or in the event of a power failure, the engagement element 21 is positively engaged with the gear wheel 18.

Figure 11:
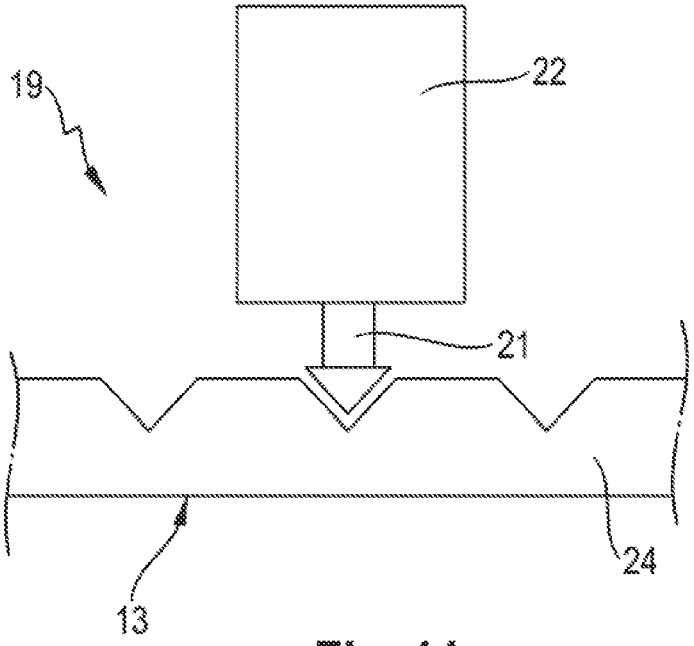
FIG. 11 shows a schematic side view of another embodiment of the blocking device of FIGS. 9-10.
Figure 12:
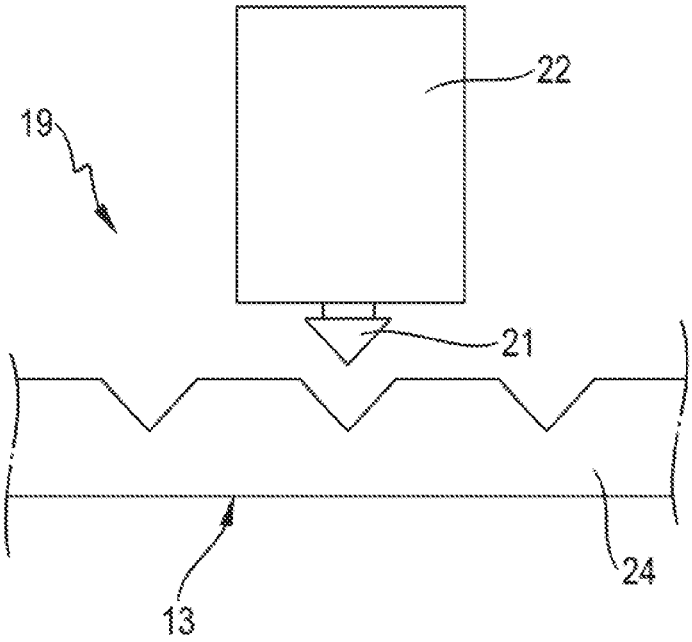
FIG. 12 shows a further schematic side view of the blocking device according to FIG. 11.

FIGS. 11-12 show a further embodiment of the blocking device 19 according to FIGS. 9-10. The blocking device 19 according to FIGS. 11-12 differs from the blocking device 19 according to FIGS. 9-10 in that the engagement element 21 does not positively engage in the gear wheel 18, but in a toothed rod 24 of an alternatively designed gear mechanism 13.

Figure 13:
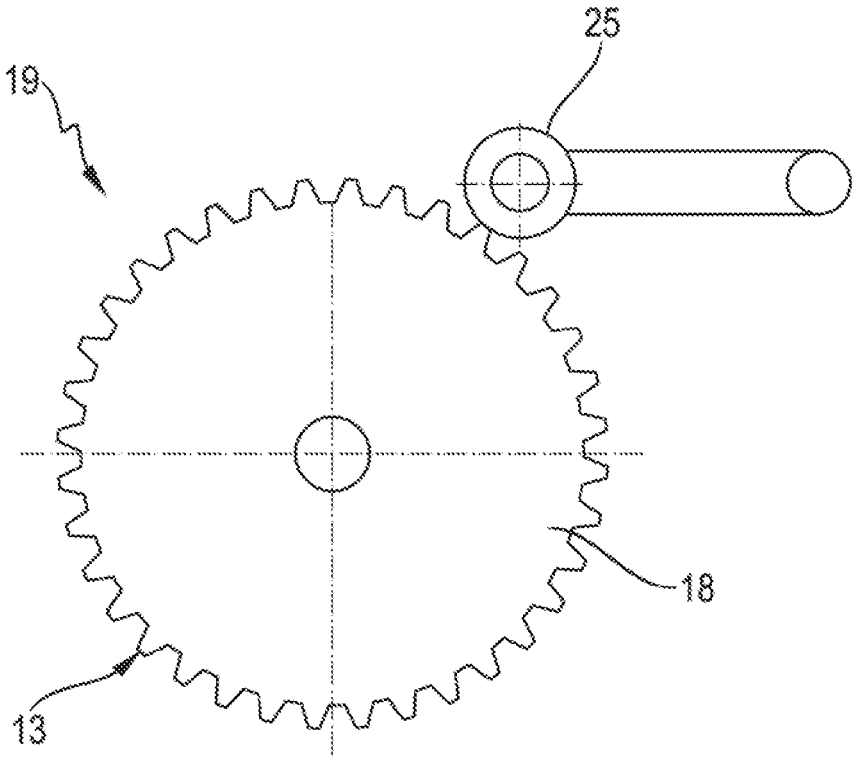
FIG. 13 shows a schematic side view of another embodiment of a blocking device for the dishwasher according to FIG. 1.
Figure 14:
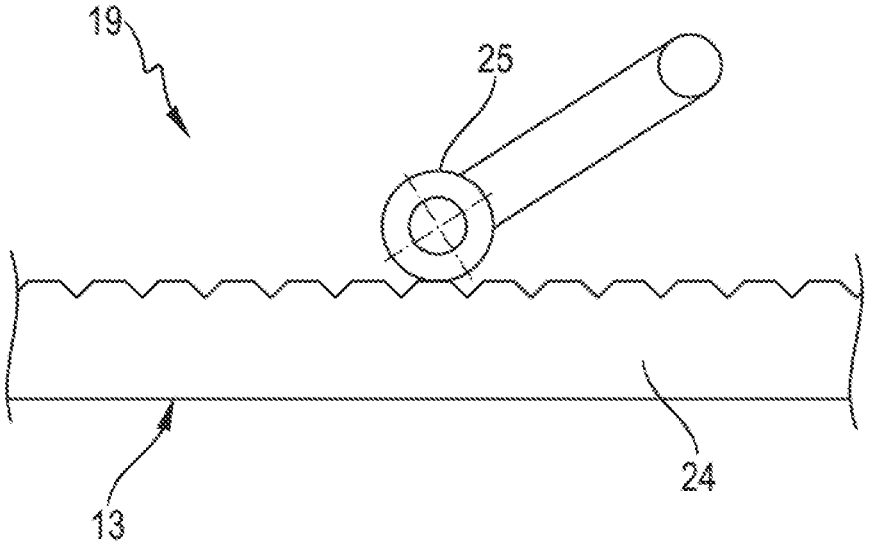
FIG. 14 shows a schematic side view of another embodiment of a blocking device for the dishwasher according to FIG. 1.

FIGS. 13-14 show another two embodiments of a blocking device 19 for the dishwasher 1 of FIG. 1. The blocking device 19 has in each case a braking element 25 which is designed to block by a frictional connection a gear wheel 18 or a toothed rod 24 of a gear mechanism 13. The braking element 25 may be a friction wheel as shown in FIGS. 13-14. Alternatively, the braking element 25 may be a brake shoe.

Figure 15:
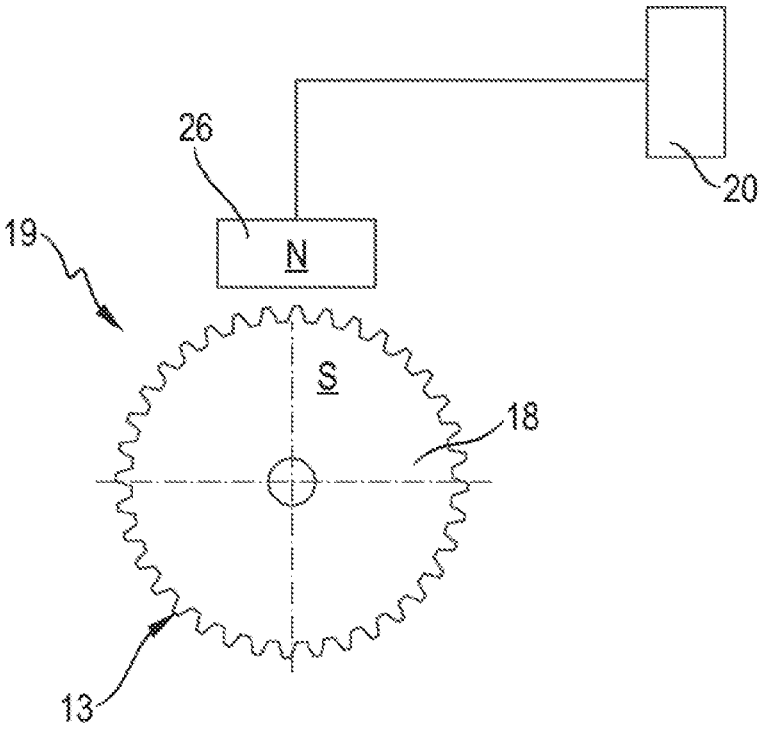
FIG. 15 shows a schematic side view of another embodiment of a blocking device for the dishwasher according to FIG. 1.
Figure 16:
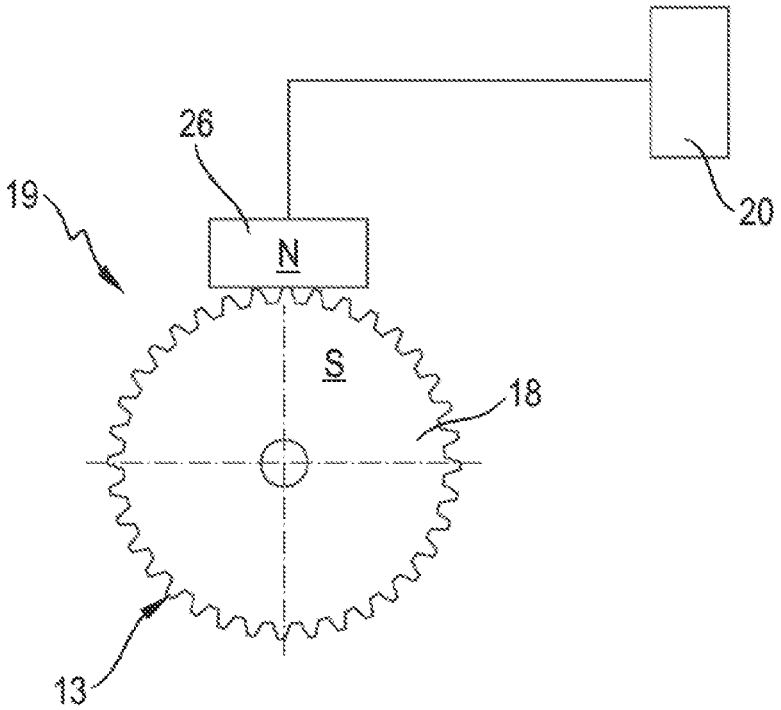
FIG. 16 shows a further schematic side view of the blocking device according to FIG. 15.

FIGS. 15-16 show another embodiment of a blocking device 19 for the dishwasher 1 of FIG. 1. The blocking device 19 has a magnet element 26 which is operatively connected to an actuating element 20. The magnet element 26 is designed to block magnetically a gear mechanism 13 and, in particular, a gear wheel 18. The magnetic element 26 may be a permanent magnet or an electromagnet. FIG. 15 shows a state of the blocking device 19 in which the actuating element 20 is activated. The magnetic element 26 is in this state lifted away from the gear wheel 18, whereby the gear wheel is freely movable. The magnetic element 26 may be a north pole N and the gear wheel 18 may be a south pole S. FIG. 16 shows a state of the blocking device 19 in which the actuating element 20 is not actuated and the gear wheel 18 is blocked. When the actuating element 20 is released, the magnetic element 26 is lowered onto the gear wheel 18, whereby the gear wheel 18 is magnetically braked and blocked.

The actuating element 20 may be mechanically coupled to the magnetic element 26, by means of a Bowden cable, for example. Alternatively, the actuating element 20 may be coupled by means of signal technology to the magnetic element 26. For example, the magnetic element 26 may be moved by means of an electric motor onto the gear wheel 18 and moved away again from the gear wheel 18. Optionally, the spacing of the magnetic element 26 from the gear wheel 18 may also be fixed, wherein the magnetic element 26 is preferably designed as an electromagnet which is switched off when the actuating element 20 is actuated and is switched on when the actuating element 20 is released.

Figure 17:
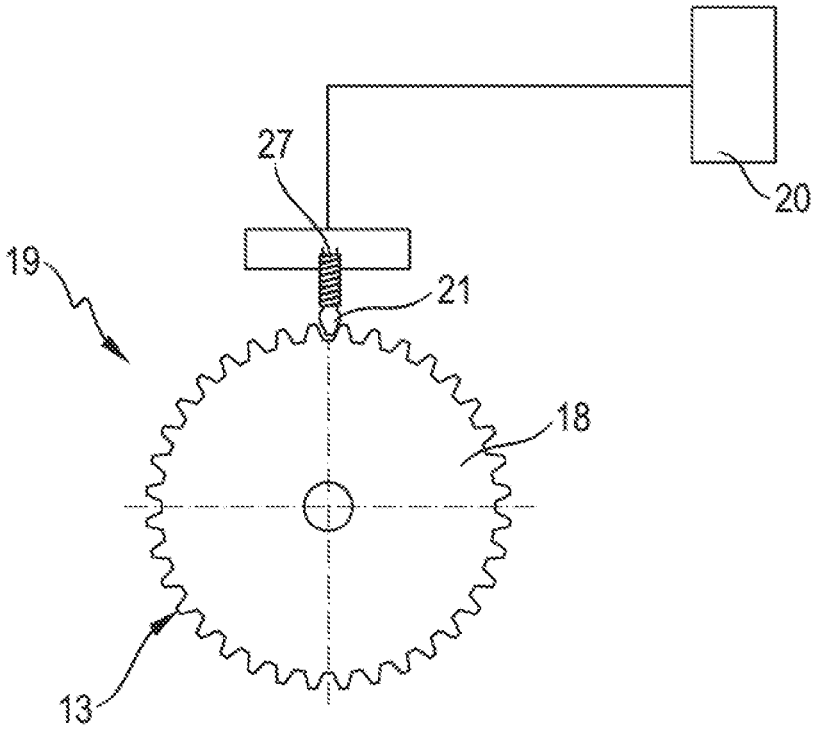
FIG. 17 shows a schematic side view of another embodiment of a blocking device for the dishwasher according to FIG. 1.

FIG. 17 shows another embodiment of a blocking device 19 for the dishwasher 1 of FIG. 1. The blocking device 19 includes an engagement element 21 which is designed to engage positively in a gear wheel 18. The engagement element 21 is spring-pretensioned by means of a spring element 27, in particular a compression spring, in a direction of the gear wheel 18. When the actuating element 20 is actuated, the engagement element 21 is lifted counter to the spring force of the spring element 27 away from the gear wheel 18, so that the gear wheel 18 is freely rotatable. An actuating element 20 of the blocking device 19 may be coupled to the engagement element 21 by means of a mechanical system or a Bowden cable.

Figure 18:
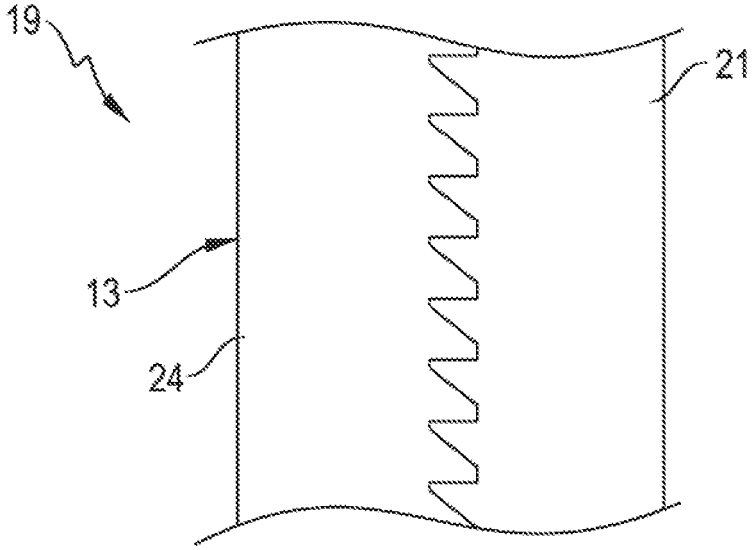
FIG. 18 shows a schematic side view of another embodiment of a blocking device for the dishwasher according to FIG. 1.

FIG. 18 shows another embodiment of a blocking device 19 for the dishwasher 1 of FIG. 1. The blocking device 19 includes an engagement element 21 in the form of a toothed coupling which is designed to engage positively in a toothed rod 24 of a gear mechanism 13.

Figure 19:
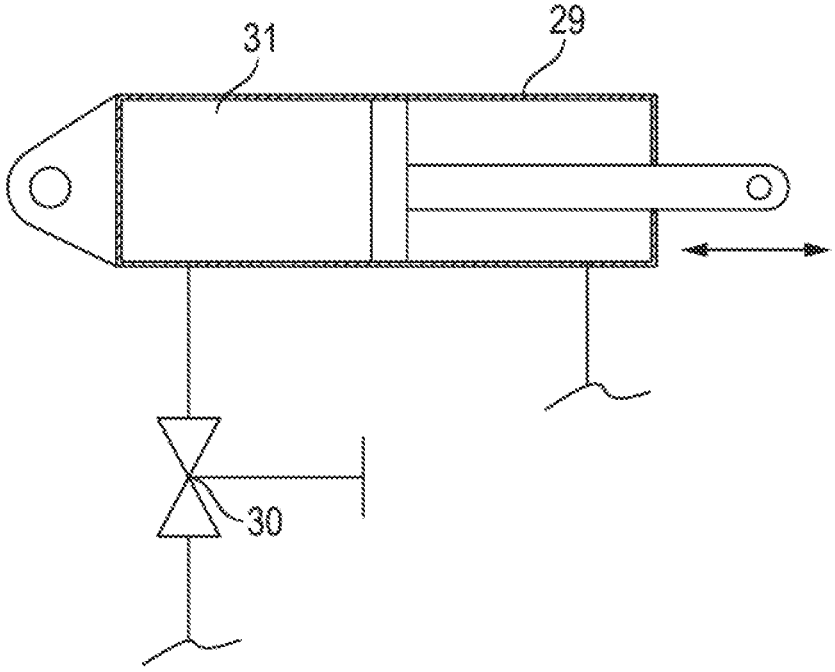
FIG. 19 shows a schematic sectional view of an embodiment of a damper unit for a dishwasher according to FIG. 1.

FIG. 19 shows a schematic sectional view of an embodiment of a damper unit 29 for a dishwasher 1 of FIG. 1. In order to be able to carry out a braking action in a lifting device 6 for a receiver for items to be washed 4, a damper unit 29 including a non-return valve 30 is used. When the non-return valve 30 is actuated, the receiver for items to be washed 4 may be moved. If the non-return valve 30 is closed, initially a damping effect is produced by the compressible fluid 31 before the receiver for items to be washed 4 subsequently comes to a standstill. The cross section of the supply line of the non-return valve 30 should be dimensioned such that sufficient actuating speed is possible on the part of the user and at the same time in the event of malfunction of the non-return valve 30 it is ensured that the receiver for items to be washed 4 is safely lowered.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A lifting device in combination with a receiver for items to be washed in a dishwasher, the lifting device being configured to displace the receiver for items to be washed from an initial position into an end position, or vice versa, the dishwasher comprising a washing container having on a front face an opening which is configured to be closed in a water-tight manner by a door, telescopic rails provided on both sides of the receiver for items to be washed such that the receiver for items to be washed is able to be pushed in or pulled out of the washing container by the telescopic rails, said lifting device comprising:

two first pivoting arms, such that, on each side of the receiver for items to be washed, one of the two first pivoting arms is attached to a corresponding one of the telescopic rails, two second pivoting arms, such that, on each side of the receiver for items to be washed, one of the two second pivoting arms is attached to a corresponding one of the telescopic rails, such that, on each side of the receiver for items to be washed, one of the two first pivoting arms and a corresponding one of the two second pivoting arms are arranged spaced apart from one another and fastened in a pivotable manner to an inner face of the washing container, a drive device which includes an electric motor and a gear mechanism, with the gear mechanism having a vertically extending drive shaft which is connected to the electric motor for imparting rotation to at least one of the first pivoting arms or the second pivoting arms, and a blocking device configured to automatically block the receiver for items to be washed in at least one intermediate position between the initial position and the end position and including an actuating element which, when actuated, is configured to unlock the blocking device such that the receiver for items to be washed can be displaced from the initial position to the end position, or vice versa, independently of the door and only for so long as the actuating element remains actuated to unlock the blocking device, wherein the receiver for items to be washed is in a shape of one of a wire frame or a basket configured to permit washing water and rinsing water to pass therethrough, and wherein the actuating element is a user-actuated element arranged on the receiver for items to be washed.

2. The lifting device of claim 1, wherein the actuating element is mechanically coupled to the blocking device.

3. The lifting device of claim 1, wherein the actuating element is coupled to the blocking device using signal technology.

4. The lifting device of claim 1, wherein the blocking device comprises the gear mechanism which includes a self-locking worm gear.

5. The lifting device of claim 1, wherein the blocking device comprises a magnetic element configured to magnetically block the gear mechanism.

6. The lifting device of claim 1, wherein the blocking device comprises an engagement element configured to positively engage in the gear mechanism in order to mechanically block the gear mechanism.

7. The lifting device of claim 6, wherein the engagement element is spring-pretensioned in a direction of a gear wheel and/or a toothed rod of the gear mechanism.

8. The lifting device of claim 6, wherein the engagement element is configured to be magnetically displaced.

9. The lifting device of claim 1, wherein the blocking device comprises a braking element configured to block the gear mechanism by a frictional connection.

10. The lifting device of claim 9, wherein the braking element is a friction wheel or a brake shoe.

11. The lifting device of claim 1, wherein the actuating element comprises one of a lever, a pushbutton, or a switch disposed on a front face of the receiver for items to be washed.

12. A dishwasher, comprising:

a washing container having on a front face an opening which is configured to be closed in a water-tight manner by a door, a receiver for items to be washed;

telescopic rails provided on both sides of the receiver for items to be washed such that the receiver for items to be washed is able to be pushed in or pulled out of the washing container by the telescopic rails, and a lifting device configured to lift the receiver for items to be washed from an initial position into an end position or lower the receiver for items to be washed from an end position into an initial position, said lifting device comprising:

two first pivoting arms, such that, on each side of the receiver for items to be washed, one of the two first pivoting arms is attached to a corresponding one of the telescopic rails, two second pivoting arms, such that, on each side of the receiver for items to be washed, one of the two second pivoting arms is attached to a corresponding one of the telescopic rails, such that, on each side of the receiver for items to be washed, one of the two first pivoting arms and a corresponding one of the two second pivoting arms are arranged spaced apart from one another and fastened in a pivotable manner to an inner face of the washing container, a drive device which includes an electric motor and a gear mechanism, with the gear mechanism having a vertically extending drive shaft which is connected to the electric motor for imparting rotation to at least one of the first pivoting arms or the second pivoting arms, and a blocking device configured to automatically block the receiver for items to be washed in at least one intermediate position between the initial position and the end position and including an actuating element which, when actuated, is configured to unlock the blocking device such that the receiver for items to be washed can be displaced from the initial position to the end position, or vice versa, independently of the door and only for so long as the actuating element remains actuated to unlock the blocking device, wherein the receiver for items to be washed is in a shape of one of a wire frame or a basket configured to permit washing water and rinsing water to pass therethrough, and wherein the actuating element is a user-actuated element arranged on the receiver for items to be washed.

13. The dishwasher of claim 12, wherein the actuating element is mechanically coupled to the blocking device.

14. The dishwasher of claim 12, wherein the actuating element is coupled to the blocking device using signal technology.

15. The dishwasher of claim 12, wherein the blocking device comprises the gear mechanism which includes a self-locking worm gear.

16. The dishwasher of claim 12, wherein the blocking device comprises a magnetic element configured to magnetically block the gear mechanism.

17. The dishwasher of claim 12, wherein the blocking device comprises an engagement element configured to positively engage in the gear mechanism in order to mechanically block the gear mechanism.

18. The dishwasher of claim 17, wherein the engagement element is spring-pretensioned in a direction of a gear wheel and/or a toothed rod of the gear mechanism.

19. The dishwasher of claim 17, wherein the engagement element is configured to be magnetically displaced.

20. The dishwasher of claim 12, wherein the blocking device comprises a braking element configured to block the gear mechanism by a frictional connection.

21. The dishwasher of claim 20, wherein the braking element is a friction wheel or a brake shoe.

22. The dishwasher of claim 12, wherein the actuating element comprises one of a lever, a pushbutton, or a switch disposed on a front face of the receiver for items to be washed.

* * * * *